US006581333B2

(12) United States Patent
Kimball

(10) Patent No.: US 6,581,333 B2
(45) Date of Patent: Jun. 24, 2003

(54) FRAME MOUNTING FOR PRISON DOOR LOCK AND METHOD EMPLOYING SAME

(75) Inventor: Gene F. Kimball, Kansas City, MO (US)

(73) Assignee: The Bratton Corporation, Kansas City, MO (US)

( * ) Notice: Subject to any disclaimer, the term of this patent is extended or adjusted under 35 U.S.C. 154(b) by 54 days.

(21) Appl. No.: 09/801,970

(22) Filed: Mar. 8, 2001

(65) Prior Publication Data

US 2003/0084616 A1 May 8, 2003

(51) Int. Cl.[7] ..... E06B 3/06; E06B 1/04

(52) U.S. Cl. ..... 49/504; 49/15

(58) Field of Search ..... 49/105, 15, 16, 49/18; 292/144, 341.16, DIG. 53; 70/466, 416, 448, 451, 417

(56) References Cited

U.S. PATENT DOCUMENTS

| | | | | |
|---|---|---|---|---|
| 15,456 A | | 7/1856 | Atterbury et al. | |
| 297,096 A | * | 4/1884 | Woehrle | 292/341.16 |
| 399,240 A | | 3/1889 | Burgess | |
| 399,329 A | | 3/1889 | Burgess | |
| 412,365 A | | 10/1889 | Burgess | |
| 421,905 A | | 2/1890 | Burgess | |
| 1,423,825 A | | 7/1922 | Anderson | |
| 1,814,938 A | | 7/1931 | Lindquist et al. | |
| 2,178,132 A | | 10/1939 | Anderson | |
| 2,200,387 A | | 5/1940 | Erath | |
| 3,410,245 A | * | 11/1968 | Kashden et al. | 116/67 R |
| 3,479,851 A | | 11/1969 | Davidson et al. | |
| 3,513,674 A | | 5/1970 | Rutherford | |
| 3,651,673 A | | 3/1972 | Sendrowski et al. | |
| 3,774,422 A | * | 11/1973 | Hogan et al. | 70/264 |
| 3,893,723 A | * | 7/1975 | Boule | 292/140 |
| 3,971,239 A | | 7/1976 | Lavis | |
| 4,139,999 A | | 2/1979 | Allenbaugh | |
| 4,180,287 A | * | 12/1979 | Youngblood et al. | 292/144 |
| 4,509,347 A | * | 4/1985 | Young | 292/140 |
| 4,593,543 A | * | 6/1986 | Stefanek | 292/114 |
| 4,635,399 A | * | 1/1987 | Gehrke et al. | 292/346 |
| 4,648,253 A | * | 3/1987 | Imhoff | 292/210 |
| 4,679,416 A | * | 7/1987 | Kambic | 292/169.3 |
| 4,685,709 A | * | 8/1987 | Kambic | 292/201 |
| 4,691,542 A | * | 9/1987 | Young | 292/140 |
| 4,881,766 A | * | 11/1989 | Schmidt et al. | 292/201 |
| 4,887,856 A | * | 12/1989 | Percoco et al. | 292/264 |
| 4,977,766 A | | 12/1990 | Beattie et al. | |
| 4,993,757 A | * | 2/1991 | Corzine | 292/144 |
| 5,035,450 A | * | 7/1991 | Muller | 292/341.16 |
| 5,100,186 A | * | 3/1992 | Nordvall | 292/144 |
| 5,406,814 A | | 4/1995 | Zeager et al. | |
| 5,722,276 A | | 3/1998 | Aigner et al. | |
| 5,737,948 A | | 4/1998 | Lefkovits | |
| 5,934,030 A | | 8/1999 | McDonald | |
| 6,079,755 A | * | 6/2000 | Chang | 292/144 |
| 6,112,471 A | * | 9/2000 | Welch et al. | 49/503 |

FOREIGN PATENT DOCUMENTS

GB 2 168 747 * 6/1986

* cited by examiner

*Primary Examiner*—Gregory J. Strimbu
(74) *Attorney, Agent, or Firm*—Shook, Hardy & Bacon L.L.P.

(57) ABSTRACT

A frame for an electromechanical prison door lock. The frame includes multiple arrays of indicia that indicate which apertures match the locations of mounting holes in at least two locks each having a different mounting configuration. A cutout formed in a face and side member of the frame form a pocket in which one of the locks is mounted. A lock cover plate is removably mounted to the frame to cover the cutout in the face and includes an opening for a lock cylinder. A latch cover plate is carried by the lock cover plate and is positioned to cover the cutout in the side member. Cutouts are provided in the latch cover plate for a lock latch bolt and a latching roller. The frame may be installed in an opening in a cell or passage wall prior to selection of the lock type.

17 Claims, 3 Drawing Sheets

FRAME MOUNTING FOR PRISON DOOR LOCK AND METHOD EMPLOYING SAME

BACKGROUND OF THE INVENTION

This invention relates generally to door frames containing locks of the type commonly used in prisons and, more particularly, to mechanisms and methods for mounting such locks in the door frames.

In prisons and other detention facilities, high security doors are commonly used to lock prisoners in their cells and to secure passageways through which the prisoners may be transported. These doors typically utilize an electromechanical lock of the type which can be remotely locked and unlocked, such as by a guard positioned in a control room sending an electronic signal to the lock to cause extension or retraction of a latch bolt. The locks also contain a keyed cylinder which allows the latch bolt to be manually extended or retracted by a guard with a key, such as in the event of a power outage which prevents the locks from being controlled by the electronic signal.

In many installations, the electromechanical locks of the type described above are mounted in the door frame, rather than the door itself, to simplify routing of the electrical cable to the lock. These door frames are typically fabricated from heavy gauge metal and contain a hollow core which is filled with concrete during installation of the frame in the concrete or block wall. The frame also contains a lock pocket in which the lock is removably mounted. A cover plate is then secured over the lock using special security screws to block access to the lock pocket and installed lock.

In order to permit proper installation and operation of the locks described above, the mounting studs and the cutouts for the latch bolt, a latching roller and the cylinder must be precisely located in the lock pocket and cover plate. Because the location of the mounting studs, latches and cylinders may vary from one lock to another, particularly when the locks are made by different manufacturers, conventional lock pockets and cover plates are specially made for the particular type of lock which is to be installed in the lock pocket. Moreover, once a conventional lock pocket has been fabricated for a specific type of lock, it may be problematic to reconfigure the lock pocket to accept another type of lock, particularly if the mounting studs and latch cutouts must be repositioned. As a result, a need exists for a door frame which can be readily modified to accept different lock configurations so that the installed lock can be easily replaced with a different brand of lock, such as if a problem develops with the installed lock.

The inability of conventional door frames to readily adapt to different lock configurations generally means that the door frames are not fabricated during the construction of new prisons or detention facilities until the specific brand of lock has been specified. If the lock specification is not established early enough in the design process, the time required to fabricate, deliver and install the door frames can cause significant and costly construction delays. As a result, a need has developed for a door frame which can be readily adapted to accept different brands of locks so that the door frames can be fabricated even though the lock specifications have not been established.

SUMMARY OF THE INVENTION

In one aspect, the present invention is directed to a door and frame assembly comprising a hinge jamb and a latch jamb extending in spaced apart and generally parallel relationship, a head jamb extending between the hinge and latch jambs at an upper end thereof. The hinge, latch and head jambs define an opening in which a door is positioned. The door is mounted by hinges to the hinge jamb and is moveable between a closed position within the opening and an open position swung away from the opening. The latch jamb comprises spaced apart first and second faces and a side member extending between the faces at said opening. A cutout in the first face and the side member of the latch jamb forms a pocket in which a lock having a cylinder and latch bolt is mounted. A lock cover plate removably covers the cutout in the first face and a latch cover plate carried by and extending from said lock cover plate removably covers the cutout in the side member of the latch jamb. A latch cutout is positioned in the latch cover plate to permit the latch bolt to be extended through the latch cover plate and a cylinder cutout is positioned in the lock cover plate to permit access to the cylinder. An array of mounting apertures are formed in the second face of the latch jamb and fasteners extend through mounting holes and removably mounting said lock within said pocket. An array of indicia are formed in the second face of the latch jamb and are positioned to designate the locations of mounting apertures for a replacement lock positioned within the pocket and having a different mounting configuration.

In another aspect, the invention is directed to a method of assembling and installing the door and frame assembly within an opening in a wall. The method comprises the steps of: (a) providing the door and frame assembly, (b) securing the door and frame assembly to the wall at said wall opening, (c) removably mounting, within the pocket, a lock having either a first or second mounting configuration by extending fasteners through the mounting apertures corresponding to the mounting configuration, and (d) removably securing, to the latch jamb, a lock cover plate sized for covering the cutout in the first face and a latch cover plate carried by the lock cover plate and sized to cover the cutout in the side member, the lock cover plate having a cylinder cutout to permit access to the lock cylinder and the latch cover plate having a latch cutout positioned to permit the latch bolt to extend through the latch cover plate.

One advantage of the door frame of the present invention is the lock mount can be readily modified to accept different lock configurations so that the door frame can be fabricated for use in prison construction even though the lock specifications have yet to be established.

Another advantage of the door frame is the lock mount can be readily modified to accept different lock configurations so that the installed lock can be replaced with a lock having a different configuration, such as if problems should develop with the lock initially installed.

BRIEF DESCRIPTION OF THE DRAWINGS

In the accompanying drawings which form part of the specification and are to be read in conjunction therewith and in which like reference numerals are used to indicate like parts in the into various views.

DESCRIPTION OF THE PREFERRED EMBODIMENTS

Figure 1:
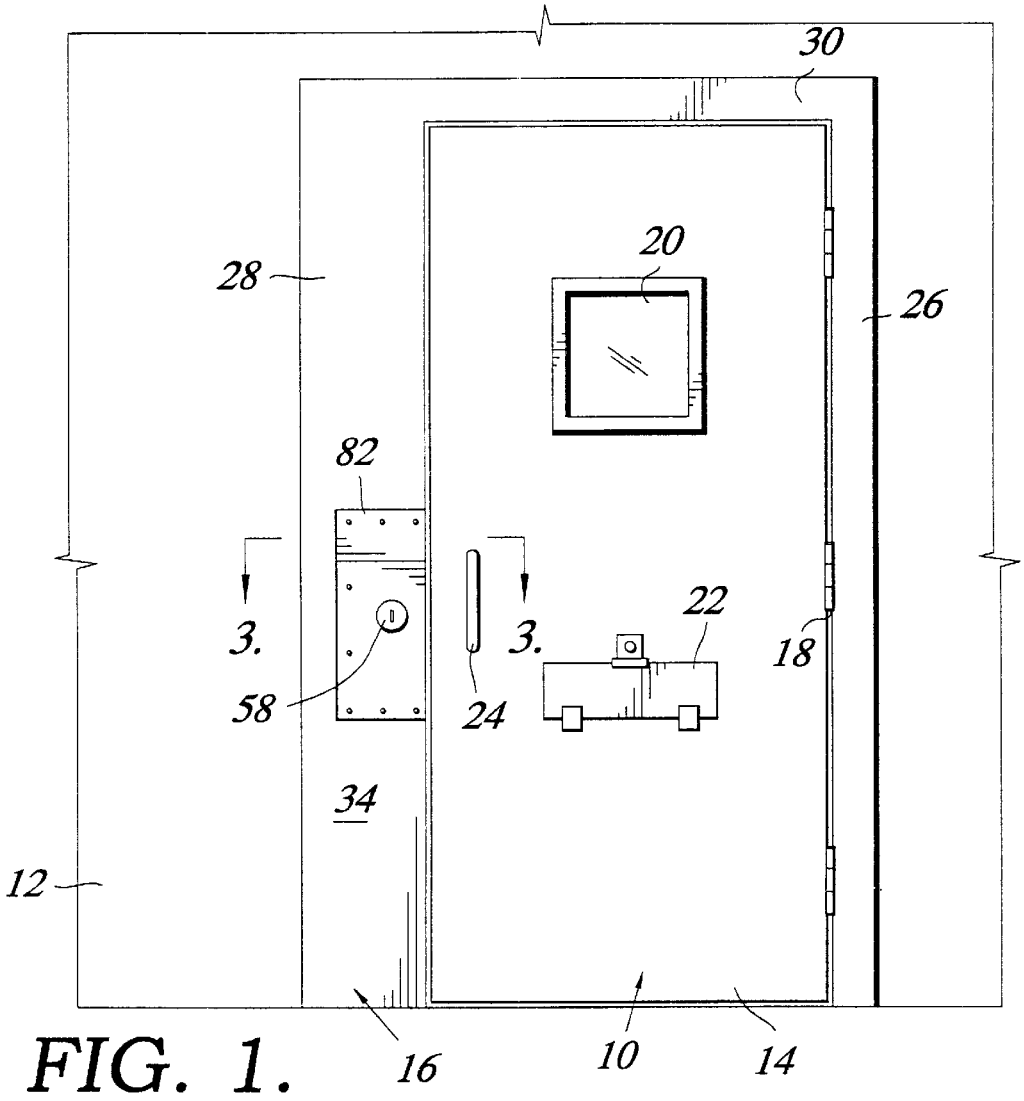
FIG. 1 is a front elevation view of a door and frame assembly of the present invention shown mounted within a wall opening.

Referring to the drawings in greater detail and initially to FIG. 1, a door and frame assembly of the present invention is designated generally by the numeral 10 and is shown installed within an opening in a wall 12. Assembly 10 includes a door 14 and a frame 16 which are constructed from a heavy gauge metal. The door 14 is mounted to the frame 16 by hinges 18 to permit swinging movement of the door from a closed, locked position and an open position permitting passage through the opening or doorway defined by the frame 16.

The door 14 is intended for use in a prison or other detention facility and may include an optional lite 20 and a slot and hatch 22 for passing a food tray or other items through the door 14. Other features customarily found in doors of this type may be included if desired. A pull-type handle 24 is provided on the face of the door 14 opposite the prison cell or other secured area to facilitate opening and closing of the door. A recessed handle (not shown) is typically provided on the opposite face of the door.

The frame 16 includes a hinge jamb 26 and a latch jamb 28 which are spaced apart and extend vertically in parallel relationship. A head jamb 30 is secured to and extends transversely between the upper ends of the hinge and latch jambs 26 and 28. The hinge jamb 26 carries the hinges 18 that mount the door 14 and permit its swinging movement. As will be described in greater detail below, the latch jamb 28 carries a lock 32 (FIG. 2) which is operable to secure the door 14 in the closed, locked position.

Figure 3:
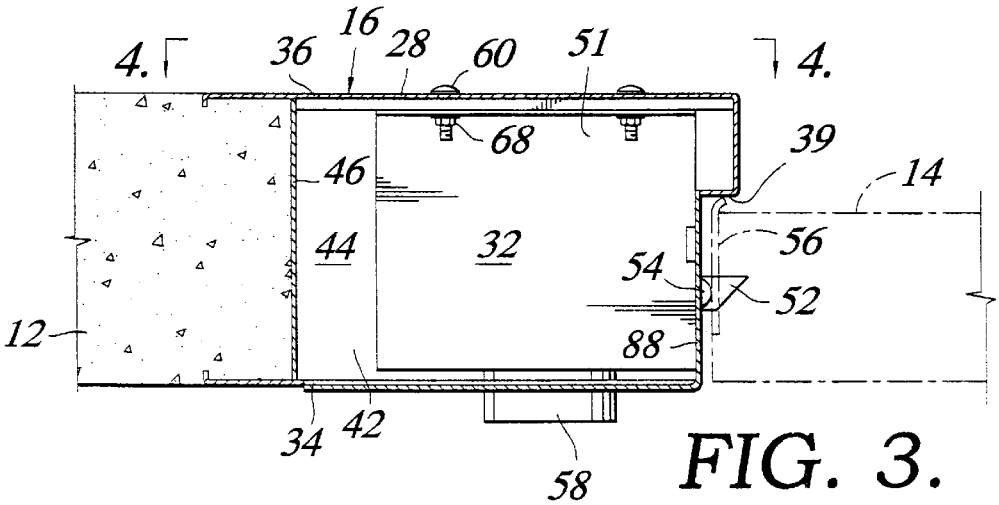
FIG. 3 is a top plan view of the door frame taken in horizontal section along line 3—3 of FIG. 1 in the direction of the arrows.

As can best be seen in FIG. 3, the latch jamb 28 is formed by spaced apart faces 34 and 36 and a side member 38 which extends between the edges of faces 34 and 36 adjacent the door opening. The side member 38 includes a two ninety degree bends which form a door stop 39 that runs the length of the latch jamb 28. The opposite edges of the jamb faces 34 and 36 are turned inwardly for imbedding in the concrete or block wall 12. The spacing between the jamb faces forms a void which can be filled with concrete to more securely anchor the frame 16. The foregoing description is also applicable to the hinge jamb 26 and head jamb 30.

Figure 2:
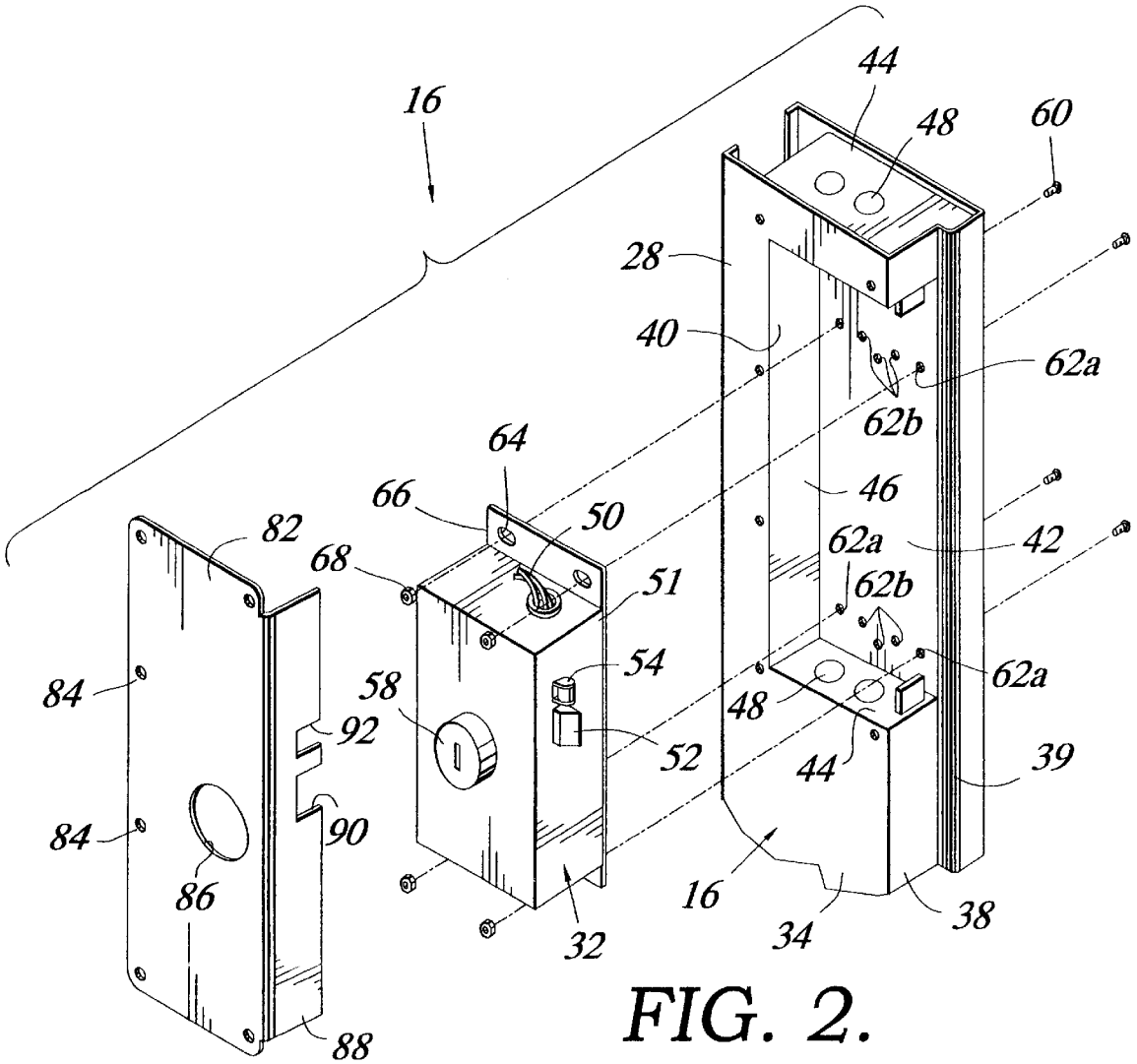
FIG. 2 is an exploded view of a fragmental portion of the door frame.

Turning additionally to FIG. 2, in accordance with the present invention, a cutout 40 is provided in the outer face 34 and side member 38 of the latch jamb 28 to form a pocket 42 in which the lock 32 is mounted. Upper and lower plates 44 and a side plate 46 extend between the spaced apart faces 34 and 36 of the latch jamb 28 to seal the pocket 42 against entry of concrete which is poured into the surrounding volume within the latch jamb 28. To prevent access to the lock pocket from the cell side of the latch jamb 28, the cutout 40 preferably does not extend into door stop 39. Knockouts 48 are provided in the plates 44 and 46 to permit electrical wires 50 or other controls to be routed to the lock 32 to permit remote operational control of the lock 32.

The lock 32 is preferably a conventional, high security, jail lock available from various manufacturers. The lock 32 will typically be operated electromechanically, but can be of other types such as pneumomechanical, electrical or mechanical. The lock 32 includes a casing 51 in which the internal workings of the lock are mounted. An extendable and retractable latch bolt 52 and a roller latch 54 extend from the side of the lock casing 51 in the direction of the facing edge of the door 14. The latch bolt 52 is extendable into a strike plate 56 carried in the edge of the door 14 to cause the door to be locked in a closed position preventing passage through the doorway. The roller latch 54 is operably coupled with the latch bolt 52 to cause the latch bolt 52 to function as a dead bolt when the roller latch 54 is depressed against the facing edge of the door. The latch bolt 52 may be retracted from the strike plate 56 to permit opening of the door by the sending of a control signal to the lock, such as by a guard in a control room, or by the turning of a key in a cylinder 58 which is accessible from a front face of the lock 32. Operation of the lock 32 in this manner is conventional in nature.

The lock 32 is mounted to the latch jamb 28 by special security bolts 60 which extend through mounting apertures 62*a* in the face 36 of the latch jamb 28 that is exposed to the prison cell or other secured area. The security bolts 60 also extend through slightly elongated holes 64 carried by flanges 66 extending from the top and bottom of the back side of the lock casing 51. Nuts 68 are then threaded onto the bolts 60 and are turned against the flanges 66 to secure the lock 32 in place.

Figure 4:
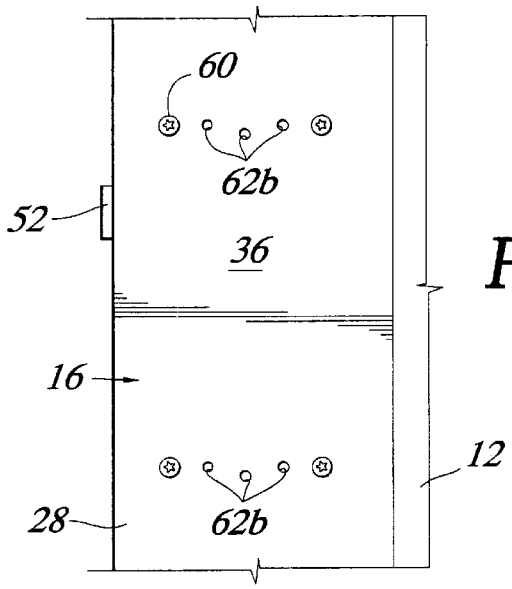
FIG. 4 is a fragmentary, rear elevation view of the door frame.

In conventional latch jambs, the mounting apertures 62*a* are normally drilled only after the specific lock type has been established and the particular location of the lock holes 64 becomes known. In the present invention, as can best be seen in FIGS. 2 and 4, the face 36 of the latch jamb 28 carries a first array of mounting apertures 62*a* which are positioned to align with the lock holes 64 in a lock having a first array of such holes 64. The face 36 also carries a second array of mounting apertures 62*b* which are positioned to align with lock holes in a lock having a different array of such lock holes. In the same manner, additional arrays of mounting apertures can be provided in the face 36 of the latch jamb 28 to align with differing arrays of lock holes carried by locks of different types or manufacturers. While predrilled mounting apertures 62*a* and 62*b* are generally preferred because they allow the lock 32 to be quickly mounted at the job site, it will be appreciated other indicia can be used to designate the location of the different arrays of mounting apertures and then, once the lock has been selected, only those mounting apertures matching the lock holes for the selected lock are drilled or otherwise formed in jamb face 36. Examples of these other types of indica can include but are not limited to markings, depressions, and areas having a perimeter defined by a line of weakness so that the areas can be punched out at the job site during installation of the lock.

Figure 6:
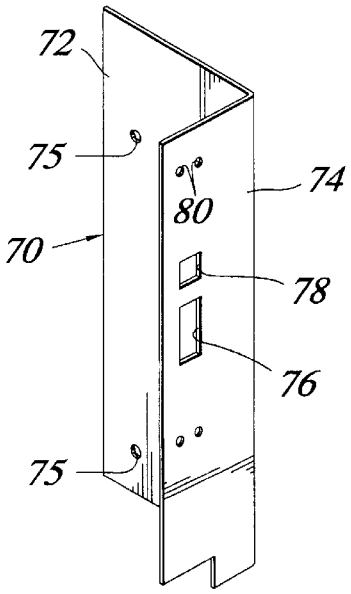
FIG. 6 is a perspective view of an adapter plate used in an alternate embodiment of the invention.

Although rear-mounted locks 32 are described above and illustrated in the drawings, other locks are available which are designed for side mounting within the latch jamb 28. These side-mounted locks (not shown) can be mounted to the rear face 34 of latch jamb 28 using an adapter plate 70 illustrated in FIG. 6. The adapter plate 70 comprises a mounting plate 72 and a latch plate 74 which is formed by a ninety degree bend at one edge of the mounting plate 72. The mounting plate 72 carries one or more arrays of mounting holes 75 which can be aligned with mounting apertures 62 in the jamb face 34. The security bolts 60 are then extended through the apertures 62 and holes 75 and nuts 68 are turned against the inside face of the mounting plate 72 to secure the adapter plate 70 to the latch jamb 28. The latch plate 74 carries cutouts 76 and 78 for the latch bolt 52 and latch roller 54, respectively, as well as mounting apertures 80 positioned to align with the side mounting holes (not shown) in the lock. Bolts or screws can be inserted through the mounting apertures 80 and into the side mounting holes to mount the lock to the adapter plate 70.

Figure 5:
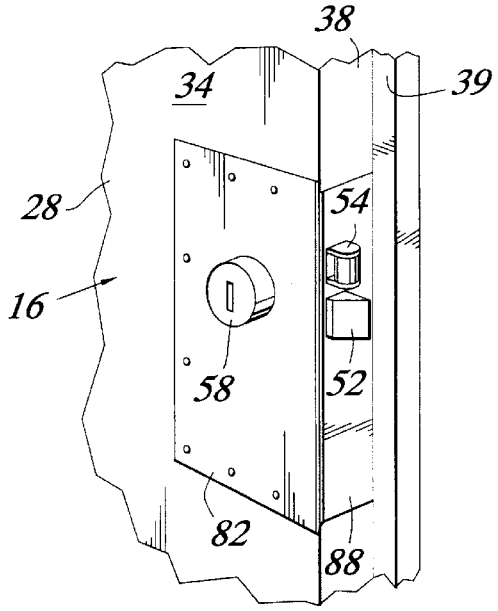
FIG. 5 is a fragmental perspective view of the door frame.

In conventional latch jambs, the cutout which permits installation of the lock 32 within the latch jamb would be positioned solely in the face of the latch jamb. Turning to FIGS. 2, 3 and 5, in the present invention, the cutout 40 extends beyond the face 36 of the latch jamb 28 and incorporates a portion of the side member 38. A lock cover plate 82 formed from heavy gauge metal is provided and is sized for covering the cutout 40 in the jamb face 36. Screw holes 84 are positioned around the perimeter of the lock cover plate 82 and screws can be used to removably secure the lock cover plate to screw holes provided in the jamb face 36. A circular cutout or opening 86 is formed in the lock cover plate 82 and is positioned for alignment with the cylinder 58 of the lock 32. The opening 86 may have an inner diameter sized slightly greater than the outer diameter of lock cylinder 58 or, alternatively, the opening 86 may be formed large enough to accommodate variously positioned lock cylinders 58.

A latch cover plate 88 is preferably fixed to or otherwise carried by the lock cover plate 82 at one edge thereof and extends at a ninety degree angle thereto. Alternatively, but less preferably, the latch cover plate 88 and lock cover plate 82 may be separate pieces. The latch cover plate 88 is formed from heavy gauge metal and is sized and positioned to cover that portion of the cutout 40 which is formed in the side member 38. A latch cutout 90 and a latch roller cutout 92 are formed in the latch cover plate 88 and are positioned to align with the latch bolt 52 and latch 54 in the particular lock 32 selected.

Because the latch cover plate 88 and lock cover plate 82 are readily attached to and removed from the latch jamb 28, they can be fashioned in different configurations for use with specific lock 32 configurations. Once the lock 32 has been selected and installed in the pocket 42 in the latch jamb 28, the latch cover plate 88 and lock cover plate 82 having the matching configuration can be selected and attached to the jamb face 36 to finish the lock installation.

It can be seen that the multiple arrays of mounting apertures 62*a* and 62*b* allow locks having different arrays of lock holes to be quickly mounted within the lock pocket 42 even after the frame 16 has been installed in the opening in wall 12. The combination of features of the present invention allows the door frame 16 to be fabricated for a particular installation even though the lock type has not yet been specified, thereby reducing the opportunity for costly construction delays. In addition, the present invention allows an installed lock to be readily removed and replaced with a lock having a different configuration of mounting holes and positioning of the lock cylinder, latch bolt and latch roller.

From the foregoing it will be seen that this invention is one well adapted to attain all ends and objects hereinabove set forth together with the other advantages which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A frame for mounting a door and permitting the door to swing between a closed, locked position and an open position, said frame comprising:

a hinge jamb and a latch jamb extending in spaced apart and generally parallel relationship;

a head jamb extending between the hinge and latch jambs at an upper end of said hinge and latch jambs, said hinge, latch and head jambs defining an opening for receiving said door when the door is in the closed position;

said latch jamb comprising spaced apart, generally parallel first and second faces and a side member extending between said faces at said opening;

a cutout in said first face and said side member of the latch jamb, said cutout forming a pocket in which a lock may be inserted and mounted;

a lock cover plate sized for covering the cutout in said first face;

a latch cover plate carried by and extending from said lock cover plate and sized to cover the cutout in the side member of the latch jamb, said lock and latch cover plates being removably mounted to the first face of the latch jamb;

a latch cutout positioned in said latch cover plate to permit a latch bolt to be extended through the latch cutout when the lock is positioned within the pocket;

a cylinder cutout positioned in said lock cover plate to permit access to a lock cylinder when the lock is positioned within the pocket;

a first array of indicia in said second face of the latch jamb designating locations of mounting apertures for the lock when the lock is positioned within said pocket and has a first mounting configuration; and at least a second array of indicia in said second face designating locations of mounting apertures for the lock when the lock is positioned within said pocket and has a second mounting configuration.

2. The frame of claim 1, wherein said indicia comprises said mounting apertures.

3. The frame of claim 1, wherein said indicia are depressions.

4. The frame of claim 1, wherein said indicia are areas each having a perimeter defined by a line of weakness which allows the area to be punched out for removal.

5. The frame of claim 1, wherein said spaced apart first and second faces define an interior void.

6. The frame of claim 1, wherein said latch cover plate extends at approximately a right angle from said lock cover plate.

7. The frame of claim 6, wherein said latch cover plate includes a second cutout spaced from the latch cutout for receiving a latching roller when the lock is positioned within the pocket.

8. The frame of claim 1, including a stop formed in said side member of the latch jamb.

9. An assembly comprising:

a hinge jamb and a latch jamb extending in spaced apart and generally parallel relationship;

a head jamb extending between the hinge and latch jambs at an upper end of said hinge and latch jambs, said hinge, latch and head jambs defining an opening;

a door mounted by hinges to said hinge jamb and moveable between a closed position within said opening and an open position swung away from the opening;

said latch jamb comprising spaced apart, generally parallel first and second faces and a side member extending between said faces at said opening;

a cutout in said first face and said side member of the latch jamb, said cutout forming a pocket;

a lock mounted within said pocket and comprising a cylinder and a latch bolt extendable into a latch carried by said door and retractable therefrom;

a lock cover plate sized for covering the cutout in said first face;

a latch cover plate sized to cover the cutout in the side member of the latch jamb, said lock and latch cover plates being removably mounted to the first face of the latch jamb;

a latch cutout positioned in said latch cover plate to permit the latch bolt to be extended through the latch cover plate;

a cylinder cutout positioned in said lock cover plate to permit access to the cylinder;

a first array of mounting apertures in said second face of the latch jamb;

fasteners extending through said mounting apertures and removably mounting said lock within said pocket; and an array of indicia in said second face designating locations of a second array of mounting apertures for a replacement lock having a different mounting configuration from said lock when the replacement lock is positioned within said pocket.

10. The assembly of claim 9, wherein said lock is selected from the group consisting of electromechanical and pneumomechanical locks.

11. The assembly of claim 9, wherein said indicia comprises said second array of mounting apertures.

12. The assembly of claim 9, wherein said indicia are depressions.

13. The assembly of claim 9, wherein said indicia are areas each having a perimeter defined by a line of weakness which allows the area to be punched out for removal.

14. The assembly of claim 9, wherein said spaced apart first and second faces define an interior void which is filled with concrete.

15. The assembly of claim 9, wherein said latch cover plate is carried by and extends at approximately a right angle from said lock cover plate.

16. The assembly of claim 15, wherein said lock includes a latching roller and said latch cover plate includes a second cutout spaced from the latch cutout for allowing said latching roller to extend through said latch cover plate.

17. The assembly of claim 9, including a stop formed in said side member of the latch jamb.

* * * * *